US006910246B2

(12) United States Patent
Desmarais

(10) Patent No.: US 6,910,246 B2
(45) Date of Patent: Jun. 28, 2005

(54) FURNITURE LEG GLIDE

(75) Inventor: Pierre Desmarais, Cantley (CA)

(73) Assignee: Innovation Engineering Group, Kanata (CA)

( * ) Notice: Subject to any disclaimer, the term of this patent is extended or adjusted under 35 U.S.C. 154(b) by 0 days.

(21) Appl. No.: 10/711,092

(22) Filed: Aug. 22, 2004

(65) Prior Publication Data

US 2005/0115022 A1 Jun. 2, 2005

Related U.S. Application Data

(60) Provisional application No. 60/481,607, filed on Nov. 6, 2003.

(51) Int. Cl.[7] ..... A47B 91/06

(52) U.S. Cl. ..... 16/42 R; 16/42 T; 16/43; 248/188.9

(58) Field of Search ..... 16/42 R, 42 T, 16/43; 248/188.4, 188.9, 346.11; 135/77, 135/84, 86, 82

(56) References Cited

U.S. PATENT DOCUMENTS

| | | | | | |
|---|---|---|---|---|---|
| 1,903,609 | A | * | 4/1933 | Uhl | 16/42 R |
| 2,457,723 | A | * | 12/1948 | Pura | 16/32 |
| 2,744,283 | A | * | 5/1956 | Reineman | 16/42 R |
| 2,820,240 | A | * | 1/1958 | Matys | 16/42 R |
| 2,921,760 | A | * | 1/1960 | Wheeler | 248/615 |
| 2,994,152 | A | * | 8/1961 | Donahue | 248/188.9 |
| 3,040,757 | A | * | 6/1962 | Smith | 135/86 |
| 3,191,213 | A | * | 6/1965 | Congdon | 16/42 R |
| 3,389,421 | A | * | 6/1968 | Wheeler | 16/42 R |
| 3,633,863 | A | * | 1/1972 | Abbey | 248/346.11 |
| 4,135,536 | A | * | 1/1979 | Willis | 135/84 |
| 4,457,530 | A | * | 7/1984 | Johnson | 280/293 |
| D338,223 | S | * | 8/1993 | Mine | D17/99 |
| 5,810,038 | A | * | 9/1998 | Carpinella | 135/77 |
| 5,826,606 | A | * | 10/1998 | Davenport | 135/82 |
| 6,154,923 | A | * | 12/2000 | Carpinella | 16/42 R |
| 6,374,841 | B1 | * | 4/2002 | Yamamoto et al. | 135/77 |
| 6,405,982 | B2 | * | 6/2002 | Ferencz | 248/188.9 |
| 6,626,405 | B1 | * | 9/2003 | Downen et al. | 248/188.9 |

FOREIGN PATENT DOCUMENTS

| | | | | | |
|---|---|---|---|---|---|
| CA | 2029911 | A | * | 5/1992 | A47B 91/00 |
| CA | 2262138 | A1 | * | 6/2000 | A47B 91/00 |

* cited by examiner

*Primary Examiner*—Chuck Mah

(57) ABSTRACT

A novel furniture leg glide is disclosed for reducing a screeching sound made by a furniture leg being dragged across a floor. The furniture leg glide is formed from a hollow body portion having an end cap disposed thereon with a flexible coupling formed along the hollow body portion between first and second ends thereof. A piece of felt type material is bonded to the end cap and the flexible coupling permits the piece of felt type material to contact the floor when the furniture leg is angularly displaced in relation to the floor within a predetermined number of degrees. The flexible coupling flexes and compresses in relation to the angular movement of the furniture leg. In accordance with another embodiment of the invention a furniture leg glide is provided for attaching to a furniture leg having a swivel base furniture leg glide disposed thereon.

33 Claims, 5 Drawing Sheets

FURNITURE LEG GLIDE

BACKGROUND OF INVENTION

This application claims priority from U.S. Provisional Application No. 60/481,607 filed on Nov. 6, 2003.

The invention relates to the field of a furniture leg glide and more specifically to the field of a furniture leg glide for being attached to a furniture leg for reducing a screeching sound resulting from the furniture leg being dragged against a floor. In many classrooms around the world teachers get annoyed with the screeching sound that results from students dragging their chairs and desks against classroom floors. Every time a student gets out of their chair, the chair typically makes a screeching sound as it moves across the floor, where the screeching sound is a result of friction between the floor and a leg of the classroom furniture. In large classrooms, where there are over 30 students, these screeching noises are especially annoying to both students and teachers since they are emitted from a number of different desks and chairs. Thus, silence during quiet time is hard to attain in the classroom because of screeching sounds emitted from continuous shuffling of chairs and desks.

There are many furniture leg glide devices in the prior art, such as for example, those described in US Application Number 20020190179, or U.S. Pat. No. 6,626,405.

US Application Number 20020190179 describes a resilient chair glide that utilizes a flexible element having a small contact area in order to minimize friction. Unfortunately, this device is adapted for being attached directly to the leg of a chair and does not prevent the floors from being scratched by the flexible element. U.S. Pat. No. 6,626,405 describes a furniture glide having a soft floor protective material for reducing friction between the glide and the floor and for prevent the floors from being scratched. Unfortunately, this device requires nailing to the bottom of a furniture leg.

There are various other furniture glides that are in the form of small disc like devices that are either adhered or screwed onto the bottom of furniture legs they have been tested in the classroom environment and they don't attach properly or they don't last.

A need therefore exists for a furniture leg glide that significantly reduces the screeching sound that results furniture being dragged along a floor. It is therefore an object of the invention to provide a furniture glide that reduces the screeching sound that results furniture being dragged along a floor. It is a further object of the invention to provide a furniture glide that minimizes damage to the floors. It is yet a further object of the invention to provide a furniture glide that facilitates removable attachment over existing furniture glides.

SUMMARY OF INVENTION

In accordance with the invention there is provided a furniture leg glide comprising: a hollow body formed from a unitary construction comprising: an upper body portion comprising a first end and a second end; a flexible coupling portion comprising a first end coupled with the second end of the upper body portion and a second end; a lower body portion comprising a first end coupled with the second end of the flexible coupling portion and a second end; an end cap comprising a first end coupled with the second end of the lower body portion and a second end; a first cavity extending from the first end of the upper body portion to the second end of the lower body portion, where the first cavity terminates at the end cap; and, a piece of felt type material coupled with the second end of the end cap, wherein the flexible coupling portion is for permitting angular displacement, within a predetermined limit, of the upper body portion with respect to the lower body portion.

In accordance with the invention there is provided a furniture leg glide comprising: a hollow body formed from a unitary construction and comprising a continuous inner wall and a continuous outer wall disposed between a first end thereof and a second end thereof; a continuous flexible coupling portion formed along a periphery of the hollow body and between the first and second ends that extends past the continuous outer wall; an end cap comprising a first end and a second end, where the first end thereof is disposed at a second end of the hollow body; an aperture formed at the first end of the hollow body, where a first cavity is formed that is bounded by the continuous inner wall, the end cap and the aperture; and, a piece of felt type material for contacting the floor disposed on the second end of the end cap.

In accordance with the invention there is provided a method of installing a furniture leg glide onto a furniture leg comprising: providing of a furniture leg glide comprising unitary construction and comprising a hollow body comprising a first end and a second end and a flexible coupling portion formed between the first end and the second end of the hollow body and a first cavity formed within the hollow body between the first and second ends thereof at an end cap where an aperture is formed at the first end of the hollow body for facilitating access to the first cavity; grasping an outside surface of the hollow body; sliding at least one of a furniture leg and a furniture leg glide into the first cavity; terminating sliding of the furniture leg glide onto the furniture leg upon the furniture leg end contacting the second end of the hollow body; and, flexing at least a portion of the flexible coupling portion upon having an end of at least one of the furniture leg and the furniture leg glide contact the end cap attached to the hollow body.

In accordance with the invention there is provided a furniture leg glide comprising: a hollow body comprising a first end and a second end; an end cap formed at the second end of the hollow body; a first cavity formed between the first end and the second end of the hollow body; a first lip disposed on the body portion proximate the first end and extending inwardly and upwardly from the body portion for partially covering the first cavity; a second lip disposed on the body portion proximate the first end approximately opposite the first lip and extending inwardly and upwardly from the body portion for partially covering the first cavity; and, an aperture formed between the first and second lips for facilitating access to the first cavity.

In accordance with the invention there is provided a method comprising: providing a furniture leg glide comprising a hollow body having a first end and a second end; providing an end cap formed at the second end of the hollow body; providing a first cavity formed between the first end and the second end of the hollow body, where the first cavity is bounded on one side by the end cap; providing a first lip disposed on the body portion proximate the first end and extending inwardly and upwardly from the hollow body for partially covering the first cavity; and, providing a second lip disposed on the hollow body proximate the first end and approximately opposite the first lip and extending inwardly and upwardly from the hollow body for partially covering the first cavity.

BRIEF DESCRIPTION OF DRAWINGS

Exemplary embodiments of the invention will now be described in conjunction with the following drawings, in which.

DETAILED DESCRIPTION

Figure 1A:
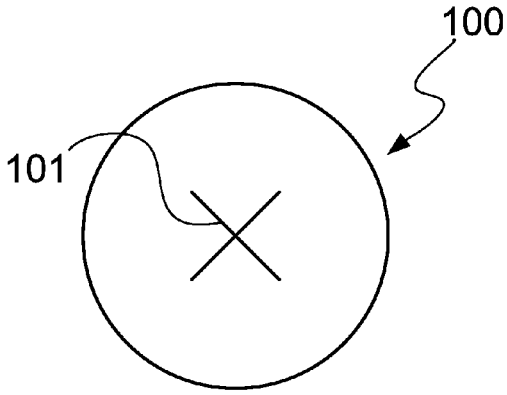
FIG. 1a (Prior Art)
FIGS. 1*a* and 1*b* illustrate a prior art furniture glide that facilitates removable attachment over existing furniture leg glides or furniture legs that are absent furniture leg glides.
Figure 1B:
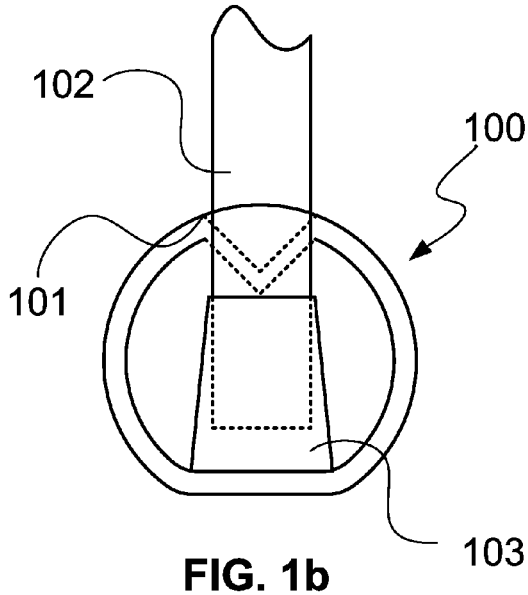
FIG. 1b (Prior Art)

FIGS. 1*a* and 1*b* illustrates a prior art furniture glide that facilitates removable attachment over existing furniture glides or furniture legs. The prior art furniture glide is for reducing a screeching sound that results from furniture legs being dragged along a floor and also serves to minimize damage to floors cause by sliding of furniture legs. The prior art furniture glide is in the form of a tennis ball 100 that has slits 101 cut therein to allow for insertion of the furniture leg into the inside of the tennis ball 100. By pushing on the slits 101, an aperture is formed for receiving of a furniture leg 102 and a conventional furniture glide 103 disposed thereon. The aperture is of a smaller diameter than that of the furniture leg 102 and associated glide 103, thus it frictionally engages the furniture leg 102 and the existing glide 103 so that it does not fall off. Unfortunately, tennis balls are known to be expensive and require dangerous labor that is involved with modifying these tennis balls in order to create the aperture therein. Furthermore, tennis balls 100 wear out quite quickly and as such have to be replaced often. Not to mention that students in the classroom tend to remove these tennis balls from the furniture legs and use them for play instead of paying attention to the teacher. Additionally in the prior art there are furniture leg glides that are manufactures using variations on the tennis ball. Unfortunately, these are also prone to the same problems in classrooms as those faced by tennis balls. A need exists to provide a furniture leg glide that reduced the screeching sound emitted from dragging furniture across a floor as well as one that facilitates attachment to a furniture leg having an existing furniture leg glide disposed thereon or to a furniture leg absent a furniture leg glide.

Figure 2A:
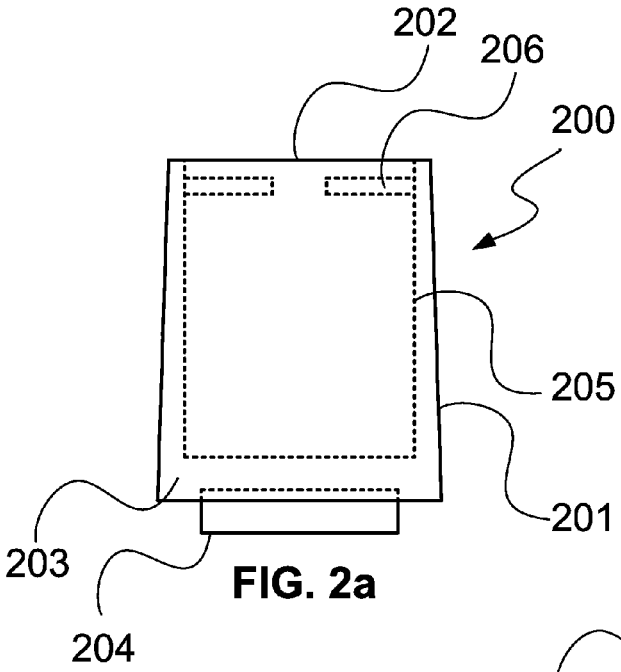
FIGS. 2*a*, 2*b* and 2*c* illustrate a furniture leg glide (FLG) in accordance with a first embodiment of the invention.
Figure 2B:
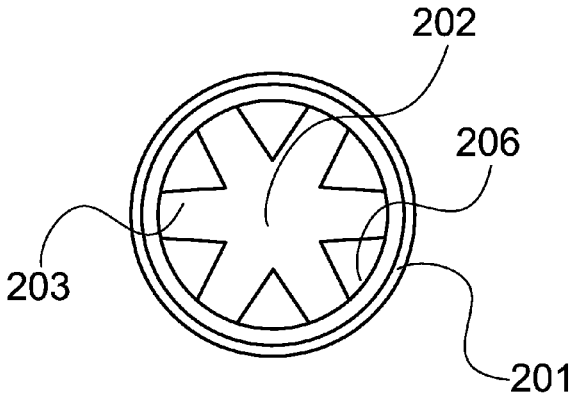
Figure 2C:
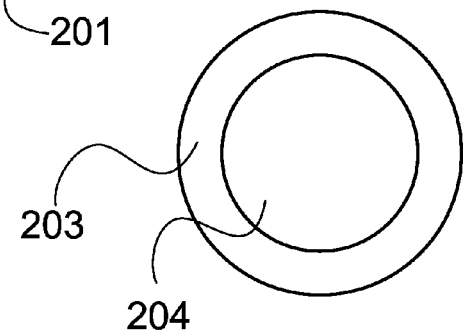

FIGS. 2*a*, 2*b* and 2*c* illustrate a furniture leg glide (FLG) 200 in accordance with a first embodiment of the invention. Referring to FIG. 2*a*, the FLG 200 includes a hollow body 201 having an aperture 202 at a first end thereof and an end cap 203 at a second end thereof. The aperture 202 is for receiving of a furniture leg (not shown in these figures). For attaching of the FLG 200 onto the furniture leg, the furniture leg is slid through the aperture 202 into an inside of the hollow body 201, where it comes to rest on a first end of the end cap 203. A piece of felt type material 204, preferably in the form of a disk, is disposed on a second surface of the end cap 203, opposite the first end that is adjacent a bottom of the furniture leg. The piece of felt type material 204 is for contacting the floor 220. Preferably the hollow body 201 is of a tubular configuration having either an elliptical cross section or a trapezoidal cross section. The cross section is of course dependent upon the furniture leg.

In order to provide additional frictional contact between the furniture leg and the FLG 200 when the furniture leg is inserted into the tubular body 201, longitudinal ribs, in the form of flexible protrusions 206, extending from the inside of the tubular body 201 proximate the aperture 202 collapse inwards and frictionally engage an outer surface of the furniture leg. These flexible protrusions 206 provides additional frictional contact between the furniture leg and the FLG 200 so that the FLG 200 does not fall off the furniture leg when the furniture is slid or raised off the floor.

Figure 3:
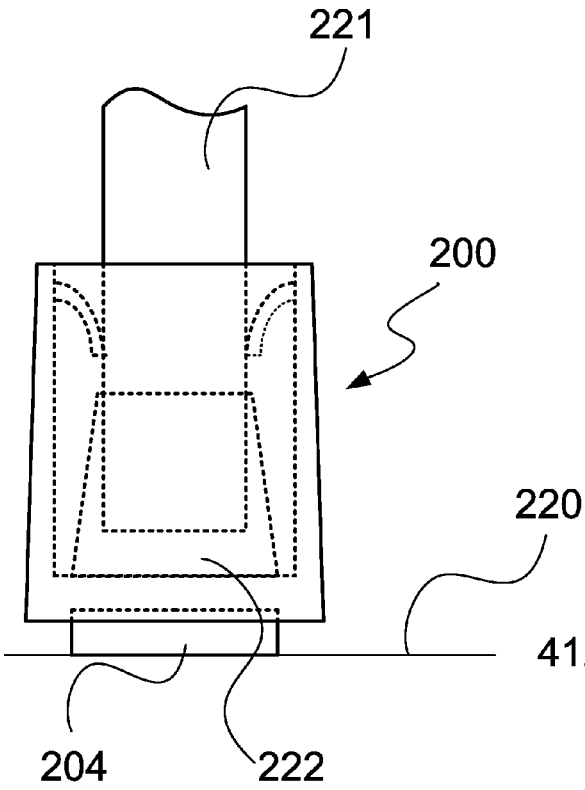
FIG. 3 illustrates a cross section of the FLG disposed on the end of a furniture leg having a conventional furniture glide disposed on an end thereof.

FIG. 3 illustrates a cross section of the FLG 200 disposed on the end of a furniture leg 221 having a conventional furniture glide 222 disposed on an end thereof. Because the FLG 200 is adapted to fit over an existing furniture glide 222, removal of existing furniture glide 222 is not performed prior to attachment of the FLG 200. The FLG 200 is advantageously disposed over the existing furniture leg glide 222 and therefore robust construction of the end cap 203 is obviated. Typically furniture legs for classroom furniture are manufactured from steel tubes and thus furniture leg glides which are attached to the ends of these tubes are made from hard plastic or rubber and are disposed on the end of the furniture leg so that the tube does not cut into the furniture glide. Advantageously disposing the FLG 200 over an existing furniture glide allows for manufacturing of the FLG 200 from inexpensive materials and also allows for easier installation. Optionally, the FLG 200 is disposed over the existing furniture leg after the existing furniture leg glide has been removed.

Figure 4:
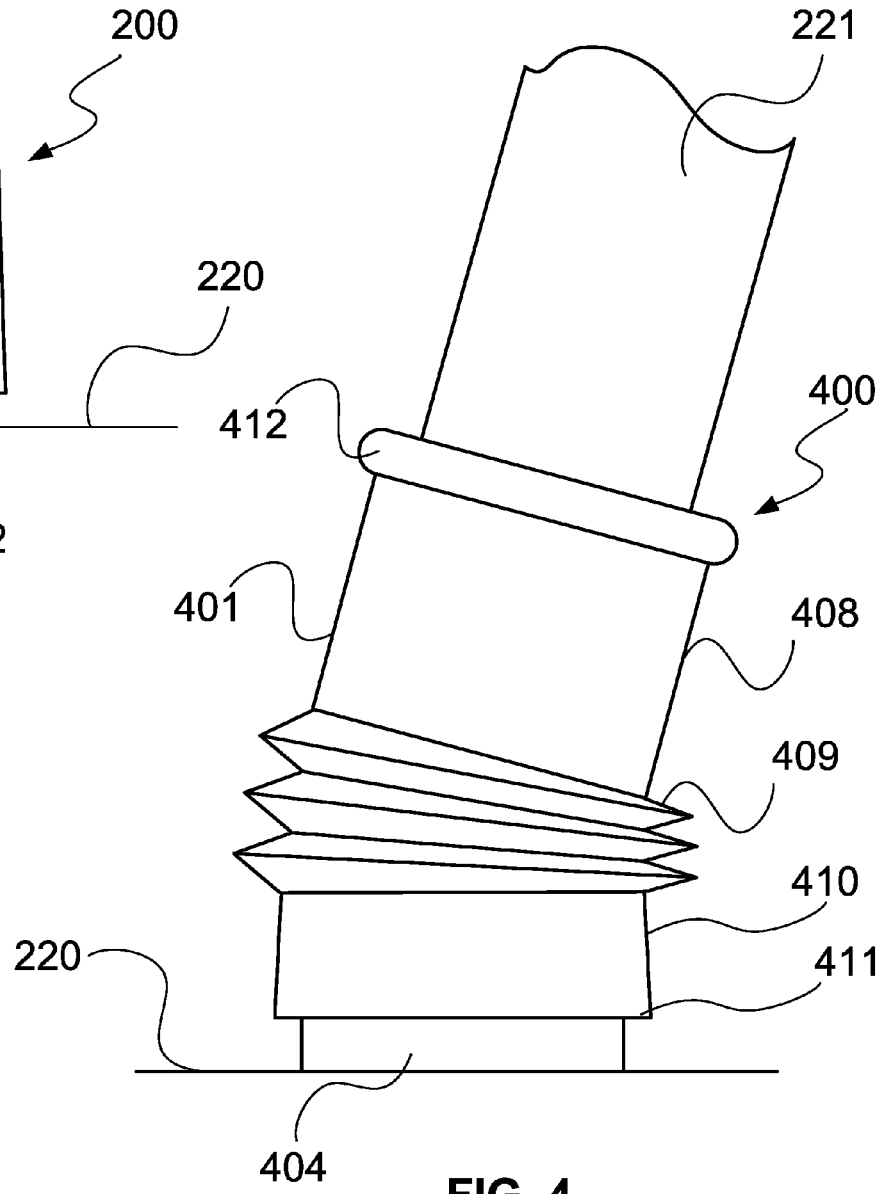
FIG. 4 illustrates a FLG in accordance with a second embodiment of the invention, where the FLG as shown provides a flexible coupling portion, in the form of an accordion like connection, between upper and lower body portions of a FLG body.

FIG. 4 illustrates a second embodiment of the invention, a FLG 400. The FLG is formed from a hollow body 401 having a unitary construction, which includes three portions and an end cap 411. The portions are: an upper body portion 408, a flexible coupling portion 409 and a lower body portion 410. The upper body portion 408 has a first end and a second end. Proximate the first end of the upper body portion 408 is an aperture for receiving of the furniture leg 221. The flexible coupling portion 409 has a first end thereof coupled with the second end of the upper body portion 408 and a second end. The lower body portion 410 has a first end thereof coupled with the second end of the flexible coupling portion 409 and a second end coupled with a first end of the end cap 411.

A first cavity is formed within the FLG 400 and it is bounded by the inner walls of the hollow body 401 and the first side of the end cap 411. Formed at a second end of the end cap 411, opposite the first end, is a second cavity. The second cavity is for receiving of a piece of felt type material 404. Preferably the flexible coupling portion 409 is in the form of an accordion type coupling which permits flexing between the upper and lower body portions. The FLG 400, as illustrated in FIG. 4, is shown in a flexed position, where the furniture leg forms an angle of approximately twenty degrees off vertical when the end of the furniture leg is fully inserted in the first cavity and resting against the end cap 411.

Advantageously when the furniture leg 221 is angled from vertical, the piece of felt type material 404 still contacts the floor 220. This flexing of the flexible coupling portion 409 results in less stress being placed on sections joining the flexible coupling portion 409 to the upper and lower body portions, 408 and 410, because the flexible coupling portion 409 between the upper and lower body portions, 408 and 410, flexes in dependence upon angular position of the furniture leg 221 relative to the floor 220. Thus, as shown in FIG. 4, as the flexible coupling portion 409 is flexed on one side it extends on the opposite side. Furthermore, for angular movement of the furniture leg 221, of approximately plus or minus thirty degrees, the piece of felt type material 411 remains in contact with the floor 220. Thus, the FLG 400 lends itself ideally to classroom chairs, where students typically balance the chair on two legs, or in some cases one leg.

Figure 5C:
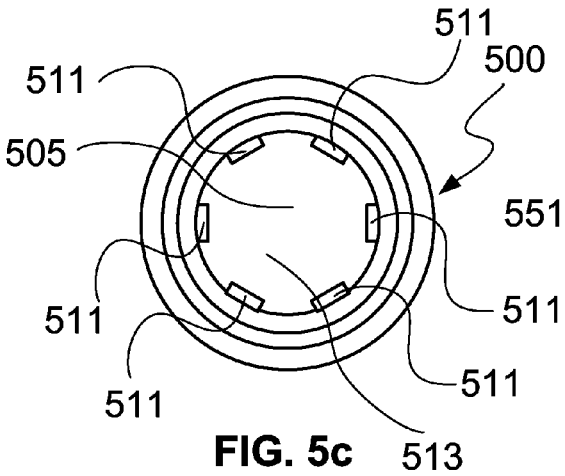
FIG. 5*c* illustrates a top view of the FLG in accordance with a third embodiment of the invention.
Figure 5A:
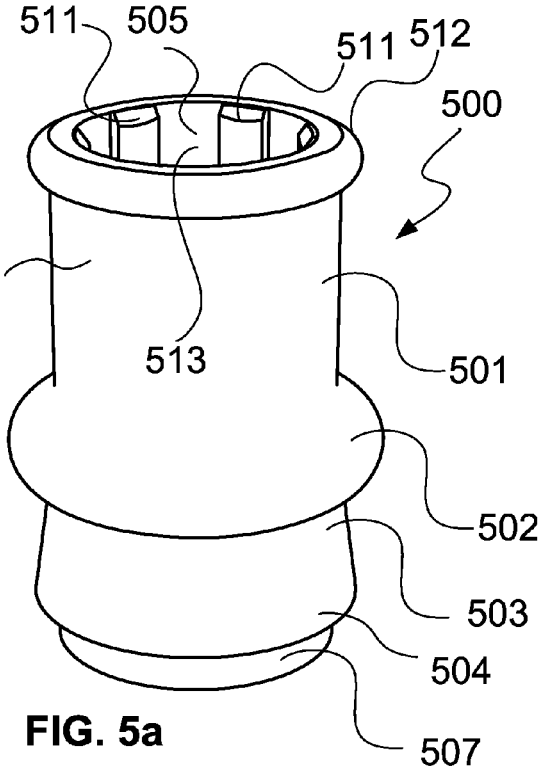
FIG. 5*a* illustrates a perspective view of a FLG in accordance with a third embodiment of the invention, where the FLG is provided with a flexible coupling portion between upper and lower body portions of a FLG body.
Figure 5D:
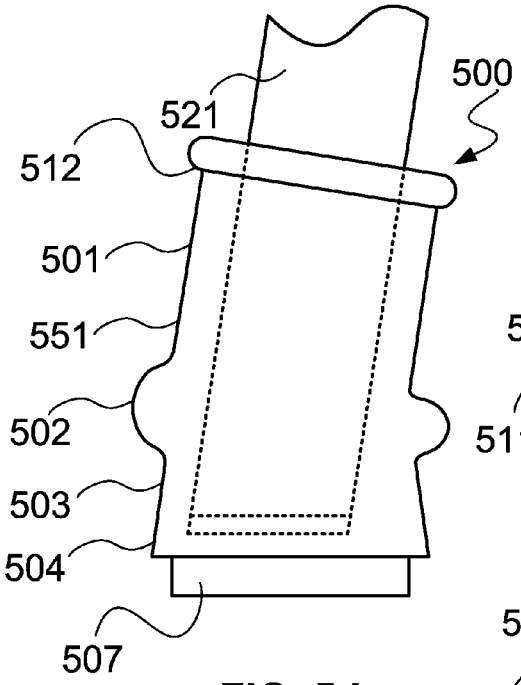
FIG. 5*d* illustrates the FLG in accordance with a third embodiment of the invention when installed on an angled furniture leg, thus showing flexing of the flexible coupling portion along one side and extending of the flexible coupling portion along an opposite side of the FLG body.
Figure 5B:
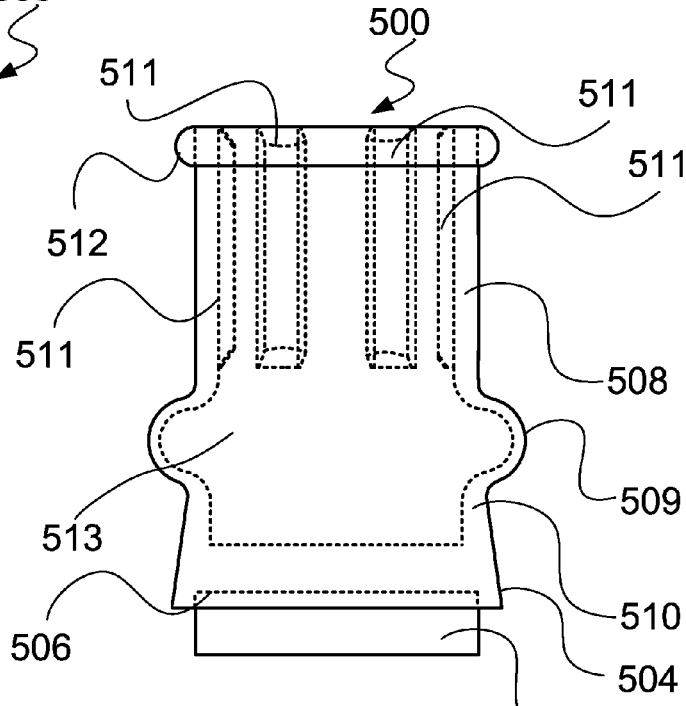
FIG. 5*b* illustrates a side view of the FLG in accordance with a third embodiment of the invention.

FIGS. 5*a*, 5*b*, 5*c* and 5*d* illustrate various views of a FLG 500 in accordance with a third embodiment of the invention. FIG. 5*a* illustrates a perspective view of the FLG 500, FIG. 5*b* illustrates a side view of the FLG 500, including details of inside construction, FIG. 5C illustrates a top view of the FLG 500, and FIG. 5*d* illustrates the FLG 500 when installed on an angled furniture leg 521.

The FLG 500 is formed from a hollow body 551, which includes three portions and an end cap 504. The portions are: an upper body portion 501, a flexible coupling portion 502, a lower body portion 503 and the end cap 504. The upper body portion 501 has a first end and a second end. Proximate the first end of the upper body portion 501 is an aperture 505 for receiving of the furniture leg 521, as shown in FIG. 5*d*. The flexible coupling portion 502 has a first end thereof coupled with the second end of the upper body portion 501 and a second end. The lower body portion 503 has a first end thereof coupled with the second end of the flexible coupling portion 502 and a second end coupled with a first end of the end cap 504.

A first cavity 513 is formed within the FLG 500 and it is bounded by the inner walls of the hollow body 551 and the first side of the end cap 504. Formed at a second end of the end cap 504, opposite the first end, is a second cavity 506. The second cavity 506 is for receiving of a portion of a piece of felt type material 507. The flexible coupling portion 502 facilitates flexing between the upper and lower body portions, 501 and 503. The FLG 500, as illustrated in FIG. 5*d*, is shown in a flexed position, where the furniture leg forms an angle of approximately fifteen degrees off vertical when the end of the furniture leg is fully inserted into the first cavity 513 and resting against the end cap 504.

A plurality of inner ribs 511 are formed on an inside surface of the upper body portion 501 for frictionally engaging the furniture leg 521. Each inner rib 511 from the plurality is preferably longitudinally disposed from the first end thereof to the second end thereof and preferably extends from the inner surface of the upper body portion 501, thus forming longitudinal ribs. When the furniture leg 521 is slid into the FLG 500, the plurality of inner ribs frictionally engage an outer surface of the furniture leg 521. Because of the flexible coupling portion 502 of the FLG 500, it permits flexing of the upper body portion 501 relative to the lower body portion 503, such as that shown in FIG. 5*d*. This flexing of the flexible coupling portion 502 preferably allows for a bottom surface of an angled furniture leg 521 to rest approximately along and approximately parallel to the end cap 504. Referring to FIG. 5*d*, the furniture leg forms an approximate angle of fifteen degrees relative to the ground and as such the upper body portion 501 also forms an angle of approximately fifteen degrees relative to the ground. Preferably the FLG 500 is designed in such a manner that the flexible coupling portion 502 allows for flexing of the upper body portion 501 relative to the lower body portion 502 to within plus or minus twenty degrees. Referring to FIG. 5*d*, the flexible coupling portion 502 is shown flexed on a first side and compressed on the opposite side when the furniture leg 521 is inserted into the first cavity 513 and has its end resting against the first side of the end cap 504. Of course, this flexing is the case when the furniture leg is angled with respect to the ground.

When a furniture leg 521 is inserted into the FLG 500, it is first inserted past the aperture 505 at the first end of the upper body portion 501, down through a second end thereof, where it is passed through first and second ends of the flexible coupling portion 502 and through a first end of the lower body portion 503. The furniture leg then abuts the first end of the end cap 504 when fully inserted into the first cavity 513, as shown in FIG. 5*d*. In the case where the furniture leg is approximately perpendicular to the ground, the flexible coupling portion does not flex on one side and extends on the opposite side, instead it flexes approximately uniformly as the furniture leg is pushed into the hollow body 551 and comes to rest on the first side of the end cap 504.

Disposed within the end cap 504 is a second cavity 506, which is formed at a second end thereof that is opposite a first end that is proximate the furniture leg 521. The cavity 506 is for receiving of a piece of felt type material 507 in such a manner that a first portion of the felt type material is disposed within the cavity and a second portion of the felt type material 507 extends from the second cavity 506. The felt type material 507 is preferably bonded to within the second cavity 506 using glue or other bonding material. Optionally, the piece of felt type material 507 is molded to within the second cavity 506. The inner walls formed by the second cavity 506 serve to mechanically engage the felt type material 507 against lateral movement, or movement that is approximately perpendicular to the inner walls of the second cavity 506. This mechanical engagement provides for added strength to the bond of the felt type material 507 to within the second cavity 506. Such a type of combination of bond and of mechanical engagement aids in holding of the felt type material 507 within the second cavity when the furniture leg is slid across the floor.

An external rib 512 is additionally disposed on an outside surface of the upper body portion 501. The external rib preferably wraps around the outer surface of the upper body portion 501, where the external rib 512 is provided for facilitating attaching of the FLG 500 onto the furniture leg 521. Thus, during an installation procedure of the FLG 500, a user grips the external rib 512 and uses it to slide the FLG 500 onto the end of a furniture leg 521. This movement slides the furniture leg 521 through the three portions, 501, 502 and 503 so that the end of the furniture leg comes to rest on the first end of the end cap 504. Optionally, a plurality of external ribs are disposed about the external surface of the upper body portion 501 for facilitating attachment of the FLG 500 to the end of the furniture leg 521.

As shown in FIG. 5*b*, a wall thickness of the flexible coupling portion 502 is preferably less than that of the upper and lower portions, 501 and 503. The wall thickness of the flexible coupling portion 502 is preferably less than that of the upper body portion wall thickness 508, which is less than that of the lower body portion wall thickness 510.

Preferably the FLG 500 is manufactured from a single piece of material, thus providing a unitary construction, where the hollow body 551 is manufactured using an injection molding process and thus the three portions, 501, 502 and 503, form a single piece of material without breaks between the different portions. This advantageously provides for a strong construction, obviating the process of gluing or bonding of the different portions together.

Figure 6A:
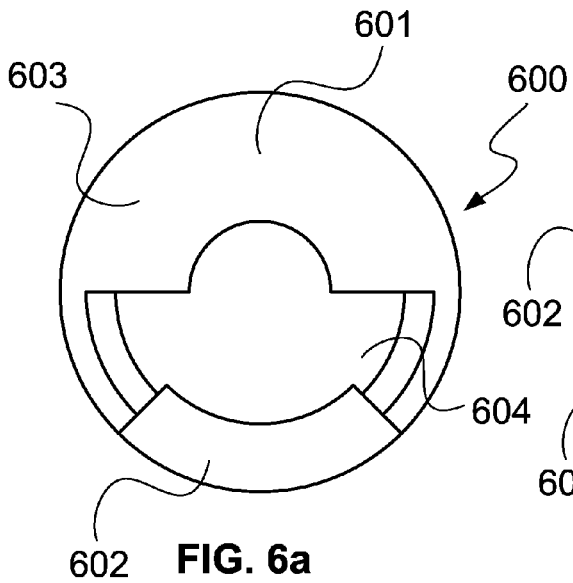
FIG. 6*a* illustrates a top view of a FLG in accordance with a fourth embodiment of the invention.
Figure 6B:
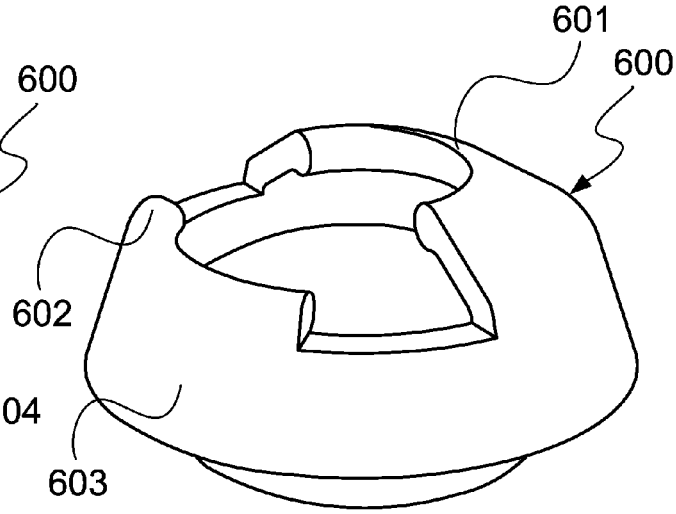
FIG. 6*b* illustrates a perspective view of the FLG in accordance with the fourth embodiment of the invention.
Figure 6C:
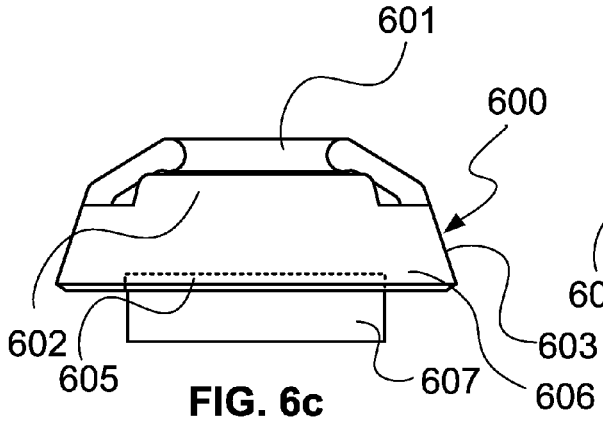
FIG. 6*c* illustrates a front view of the FLG in accordance with the fourth embodiment of the invention.
Figure 6D:
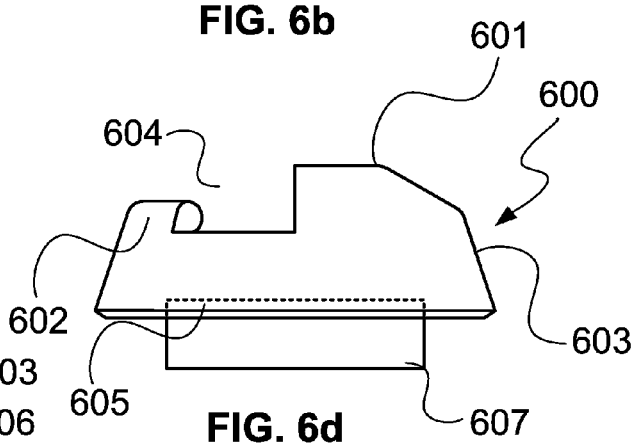
FIG. 6*d* illustrates a side view of the FLG in accordance with the fourth embodiment of the invention.
Figure 6E:
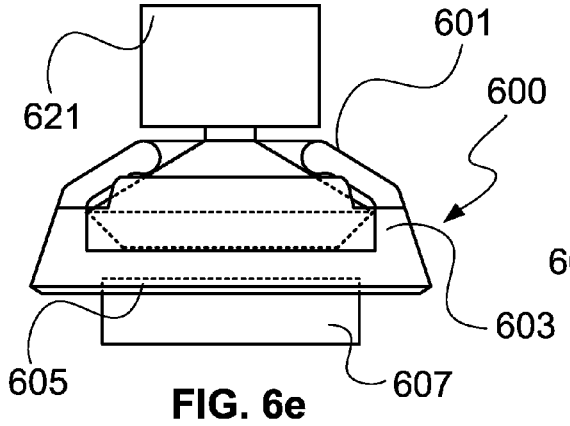
FIGS. 6*e* and 6*f* illustrate the FLG in accordance with the fourth embodiment of the invention, where the FLG is mounted to an existing swivel furniture leg glide.
Figure 6F:
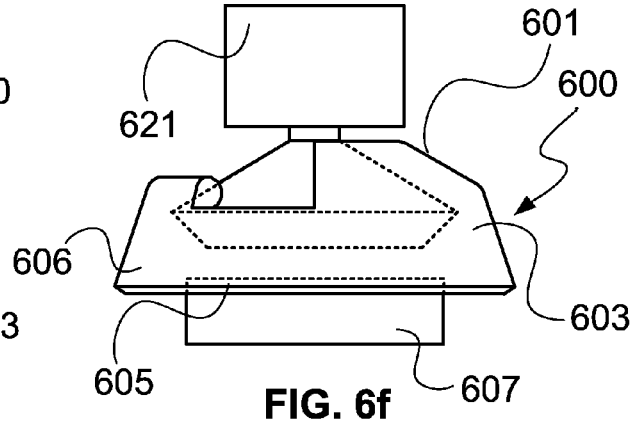

FIGS. 6*a* through 6*f* illustrate a FLG 600 in accordance with a fourth embodiment of the invention. FIG. 6*a* illustrates the FLG 600 from a top view, FIG. 6*b* illustrates the FLG 600 from a perspective view. FIG. 6*c* illustrates the FLG 600 from a front view and FIG. 6*d* illustrates the FLG 600 from a side view. FIGS. 6*e* and 6*f* illustrate the FLG 600 with an existing swivel furniture leg glide 621 of a furniture leg disposed therein. The swivel furniture leg glide 621 is formed from a portion that attaches to the end of the furniture leg and mounted to this portion using a swivel mechanism is a swivel base of the swivel furniture leg glide 621. The fourth embodiment of the invention is for attaching to this swivel base of the swivel furniture leg glide 621.

Referring to FIGS. 6*a*, 6*c* and 6*d*, the FLG 600 is comprised of a hollow body 603, having preferably unitary construction, and having an aperture formed at a first end thereof and an end cap 606 formed at a second end thereof. Between the aperture and the end cap 606 a first cavity 604 is formed. Extending from the body portion 603 from the first end thereof is a first lip 601 and a second lip 602. The first lip 601 extends in an inward and upward direction and covers approximately half of the first cavity 604. The second lip 602 also extends from the first end of the body portion 603 but is preferably disposed in such a manner that it is at an opposite end of the hollow body 603. The second lip 602 also extends inwards and upwards from the first end of the hollow body 603, however it extends less than that of the first lip 601 and covers less of the first cavity 604. Between the two lips, there is access to the first cavity 604, however the aperture formed between the first and second lips, 601 and 602, which provides access to the first cavity 604 is reduced because of the first and second lips, 601 and 602, which extend inwards, towards a center of the first cavity and upwards, away from the first end of the hollow body 603.

Disposed within the end cap 606 is a second cavity 605, which is formed at a second end thereof that is opposite a first end that is proximate the swivel base of the furniture leg glide 621. The second cavity 605 is for receiving of a piece of felt type material 607 in such a manner that a first portion of the felt type material 607 is disposed within the second cavity 605 and a second portion of the felt type material 607 extends from the second cavity 605. The felt type material 607 is preferably bonded within the second cavity 605 using glue or other bonding material. The walls formed by the second cavity 605 serve to mechanically engage the felt type material 607 against lateral movement, or movement that is approximately perpendicular to the walls of the second cavity 605. This mechanical engagement provides for added strength to the bond of the felt type material 607 to within the second cavity 605. Such a combination of bonding and of mechanical engagement aids in holding of the felt type material 607 within the second cavity 605 when the furniture leg is slid across the floor since most forces that are exerted on the felt type material 607 are lateral forces. Thus, embedding a portion of the felt type material 607 within the second cavity 605 advantageously provides for added mechanical strength so that the piece of felt type material 607 does not fall off the FLG 600.

Referring to FIGS. 6*e* and 6*f*, the access to the first cavity 604 formed between the two lips, 601 and 602, allows for the insertion of the swivel furniture leg glide 621. For inserting of the swivel furniture leg glide a swivel base of the swivel furniture leg glide 621 is first inserted under the first lip 601 at an angle of approximately thirty to forty five degrees relative to the hollow body 603. It is then pushed under the first lip so that a part of the swivel base is within the first cavity 604. Thereafter the second lip 602 is pulled away from the first lip 601, thus permitting tilting of the swivel base in such a manner that a bottom thereof rests against a first end of the end cap 606 and the first cavity is approximately fully filled by the swivel base. The second lip 602 is thereafter released and it rests against an upper surface of the swivel base, putting pressure thereon and thus holding the swivel furniture leg glide within the first cavity 604.

The FLG 600 is preferably formed from a single piece of rubber material. Because rubber material is used, it permits flexing of the hollow body 603, as well as flexing of the first and second lips, 601 and 602, to permit insertion of the swivel leg glide base into the first cavity 604. Of course, other materials such as multi part polymers and silicone rubbers are also envisaged.

Figure 7A:
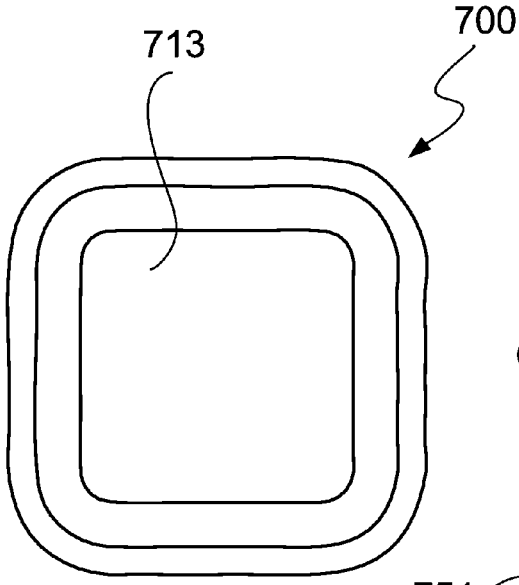
FIG. 7*a* illustrates a top view of a FLG in accordance with a fifth embodiment of the invention.
Figure 7B:
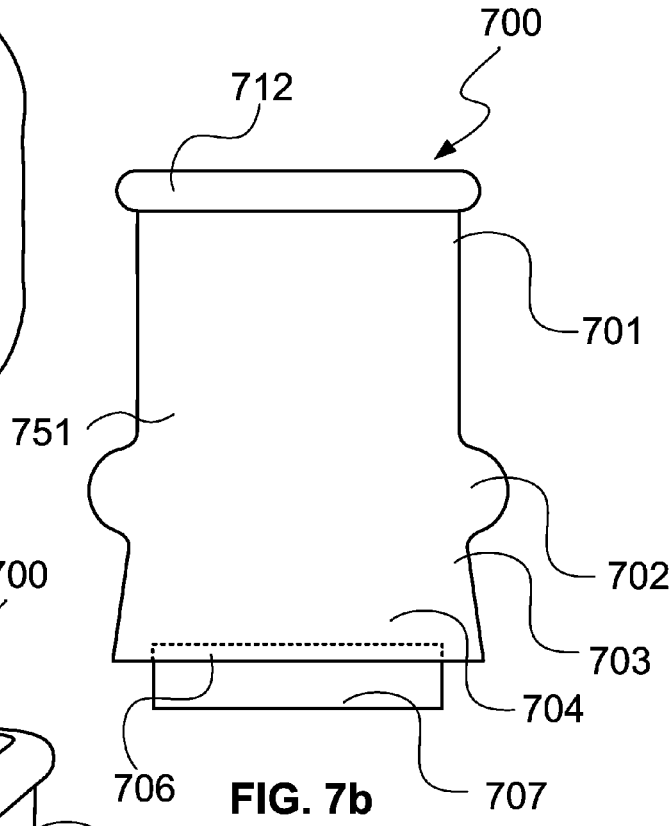
FIG. 7*b* illustrates a side view of the FLG in accordance with the fifth embodiment of the invention; and, FIG. 7*c* illustrates a perspective view of the FLG in accordance with the fifth embodiment of the invention.
Figure 7C:
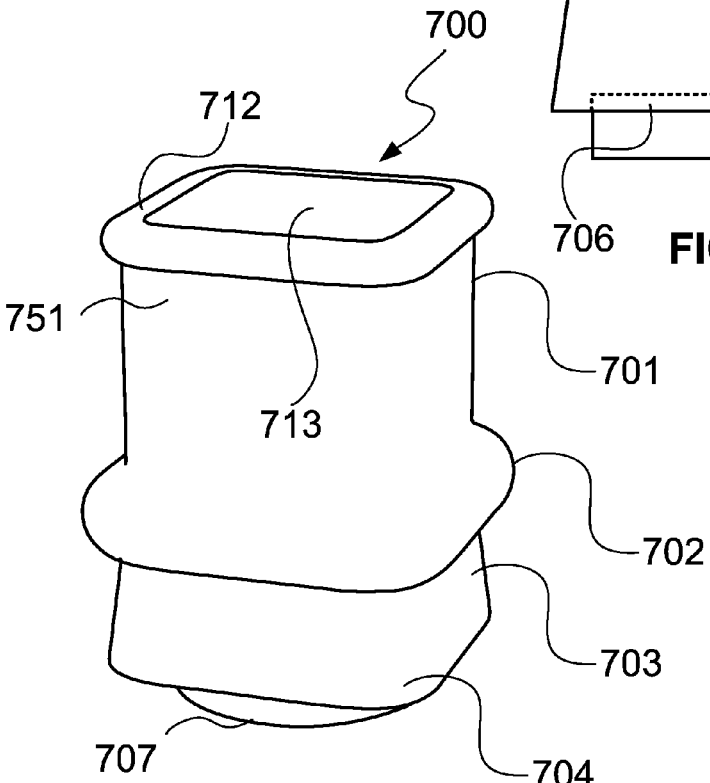

FIGS. 7*a* through 7*c* illustrate a FLG 700 in accordance with a fifth embodiment of the invention, which is a variation of the third embodiment of the invention shown in FIGS. 5*a* through 5*b*. FIG. 7*a* illustrates the FLG 700 from a top view, FIG. 7*c* illustrates the FLG 700 from a perspective view and FIG. 7*b* illustrates the FLG 700 from a side view.

The FLG 700 is formed from a hollow body 751, having a unitary construction, which includes three portions and an end cap 704. The portions are: an upper body portion 701, a flexible coupling portion 702, a lower body portion 703 and the end cap 704. The upper body portion 701 has a first end and a second end. Proximate the first end of the upper body portion 701 is an aperture 705 for receiving of a furniture leg (not shown). The flexible coupling portion 702 has a first end thereof coupled with the second end of the upper body portion 701 and a second end. The lower body portion 703 has a first end thereof coupled with the second end of the flexible coupling portion 702 and a second end coupled with a first end of the end cap 704.

A first cavity 713 is formed within the FLG 700 and it is bounded by the inner walls of the hollow body 751 and the first side of the end cap 704. Formed at a second end of the end cap 704, opposite the first end, is a second cavity 706. The second cavity 706 is for receiving of a piece of felt type material 707. The flexible coupling portion 702 facilitates flexing between the upper and lower body portions, 701 and 703.

Disposed within the end cap 706 is a second cavity 705, which is formed at a second end thereof that is opposite a first end that is proximate the swivel bas of the furniture leg glide 721. The cavity 705 is for receiving of a piece of felt type material 707 in such a manner that a first portion of the felt type material is disposed within the second cavity 705 and a second portion of the felt type material 707 extends from the second cavity 705. The felt type material 707 is preferably bonded within the second cavity 705 using glue or other bonding material. The walls formed by the second cavity 705 serve to mechanically engage the felt type material 707 against lateral movement, or movement that is approximately perpendicular to the walls of the second cavity 705. This mechanical engagement provides for added strength to the bond of the felt type material 707 to within the second cavity 705. Such a combination of bonding and of mechanical engagement aids in holding of the felt type material 707 within the second cavity 705 when the furniture leg is slid across the floor since most forces that are exerted on the felt type material 707 are lateral forces. Thus, embedding a portion of the felt type material 707 within the second cavity 705 advantageously provides for added mechanical strength so that the felt type material does not fall off the FLG 700. As shown in FIGS. 7*a* through 7*c*, the FLG 700 is approximately trapezoidal in cross section with rounded corners, as is apparent in FIG. 7*a*. Other variations of the cross section are also envisaged, for example approximately triangular and approximately square.

In many cases removal of existing furniture leg glides is difficult and thus disposing the furniture leg glide in accordance with the embodiments of the invention over an existing furniture leg glide is highly advantageous. Furthermore, valuable installation time is saved by attaching of the furniture leg glides, in accordance with the embodiments of the invention, over the existing furniture leg glides.

Advantageously, with respect to the fifth, second and third embodiments, when a furniture leg is angled from vertical, the piece of felt type material still contacts the floor. This potentially results in less stress being placed on the connection between the lower body portion because the flexible coupling portion between the upper and lower body portions flexes in dependence upon angular movement of the furniture leg relative to the floor. Furthermore, for angular movement of the furniture leg, the piece of felt type material remains in contact with the floor.

The FLG, in accordance with the embodiments of the invention, lends itself ideally to classroom chairs, where students typically balance the chair on two legs, or in some cases one leg. The fourth embodiment of the invention also facilitates having the felt remaining in contact when the chair is rocked on two legs since it attaches in a releasable manner to the swivel base of the swivel base chair glide.

Preferably the FLGs are manufactured from a soft material, such as rubber, and the piece of felt type material is preferably elliptical in cross section and contains at least some wool fibers, thus, the felt type material does not wear as easily and also reduces the screeching sound emitted when a furniture leg is dragged against the floor and is of such a composition that it minimizes damage to the floors. Preferably the piece of felt type material is made from a fibrous material that does not significantly scratch floors or wear down at an accelerated pace when slid across the floor over time.

Optionally, the cross section of the tubular portion of the FLG and is square or rectangular. Preferably the FLG in accordance with the embodiments of the invention has aesthetic qualities that do not appeal to students so that they do not result in being play toys.

Numerous other embodiments may be envisaged without departing from the spirit or scope of the invention.

What is claimed is:

1. A furniture leg glide comprising:

a hollow body formed from a unitary construction comprising:

an upper body portion comprising a first end and a second end;

a flexible coupling portion comprising a first end coupled with the second end of the upper body portion and a second end;

a lower body portion comprising a first end coupled with the second end of the flexible coupling portion and a second end;

an end cap comprising a first end coupled with the second end of the lower body portion and a second end;

a first cavity extending from the first end of the upper body portion to the second end of the lower body portion, where the first cavity terminates at the end cap; and, a piece of felt type material coupled with the second end of the end cap, wherein the flexible coupling portion is for permitting angular displacement, within a predetermined limit, of the upper body portion with respect to the lower body portion.

2. A furniture leg glide according to claim 1 wherein the end cap comprises a second cavity wherein the piece of felt type material is partially disposed within the second cavity and a rest thereof protrudes from the first cavity extending past the second end of the end cap.

3. A furniture leg glide according to claim 1 comprising a plurality of longitudinal ribs extending into the first cavity and disposed longitudinally from the first end towards the second end of the upper body portion for frictionally engaging an outside surface of a furniture leg when the furniture leg is inserted into the first cavity.

4. A furniture leg glide according to claim 3 wherein the furniture leg is one of absent an existing furniture leg glide and other than absent an existing furniture leg glide.

5. A furniture leg glide according to claim 1 comprising an outer rib disposed about an outer surface of the upper body portion and extending therefrom for facilitating attachment of the furniture leg glide onto a furniture leg when the furniture leg is inserted into the first cavity.

6. A furniture leg glide according to claim 1 wherein the first cavity is one of approximately elliptical in cross section and approximately trapezoidal in cross section and approximately triangular in cross section.

7. A furniture leg glide according to claim 1 wherein the hollow body is formed from a flexible material.

8. A furniture leg glide according to claim 1 wherein the piece of felt type material comprises a first side and a second side approximately opposite the first side; and, wherein the end cap comprises a second cavity for receiving of the first side of the felt type material, wherein the felt type material is recessed within the second cavity in such a manner that the first side is coupled to within the second cavity and the second side extends from the second cavity and past the second end of the end cap.

9. A furniture leg glide according to claim 8 wherein the piece of felt type material is bonded within the second cavity using an adhesive.

10. A furniture leg glide according to claim 1 wherein the piece of felt type material comprises a fibrous material that is for reducing damage to floors when slid across them.

11. A furniture leg glide according to claim 1 wherein the flexible coupling portion comprises a wall thickness, wherein the wall thickness of the flexible coupling portion is less than at least one of the upper and lower body portions thus permitting angular displacement of the upper body portion with respect to the lower body portion in such a manner that the flexible coupling portion extends on a first side and compresses on an opposite side during the angular displacement of the upper body portion with respect to the lower body portion.

12. A furniture leg glide according to claim 1 wherein the furniture leg glide comprises other than a spherical shape and other than felt type material disposed about the hollow body.

13. A furniture leg glide comprising:

a hollow body formed from a unitary construction and comprising a continuous inner wall and a continuous outer wall disposed between a first end thereof and a second end thereof;

a continuous flexible coupling portion formed along a periphery of the hollow body and between the first and second ends that extends past the continuous outer wall;

an end cap comprising a first end and a second end, where the first end thereof is disposed at a second end of the hollow body;

an aperture formed at the first end of the hollow body, where a first cavity is formed that is bounded by the continuous inner wall, the end cap and the aperture; and, a piece of felt type material for contacting the floor disposed on the second end of the end cap.

14. A furniture leg glide according to claim 13 wherein the end cap comprises a second cavity formed at the second end thereof wherein the piece of felt type material is partially disposed within the second cavity and a rest thereof protrudes from the first cavity extending past the second end of the end cap.

15. A furniture leg glide according to claim 13 comprising a plurality of longitudinal ribs extending into the first cavity and disposed longitudinally from the first end towards the second end of the upper body portion for frictionally engaging an outside surface of a furniture leg when the furniture leg is inserted into the first cavity.

16. A furniture leg glide according to claim 15 wherein the furniture leg is one of absent an existing furniture leg glide and other than absent an existing furniture leg glide.

17. A furniture leg glide according to claim 13 comprising an outer rib disposed about an outer surface of the upper body portion for facilitating attachment of the furniture leg glide onto a furniture leg when the furniture leg is inserted into the first cavity.

18. A furniture leg glide according to claim 13 wherein the first cavity is one of approximately elliptical in cross section and approximately trapezoidal in cross section and approximately triangular in cross section.

19. A furniture leg glide according to claim 13 wherein the piece of felt type material comprises a first side and a second side approximately opposite the first side; and, wherein the end cap comprises a second cavity for receiving of the first side of the felt type material, wherein the felt type material is recessed within the second cavity in such a manner that the first side is coupled to within the second cavity and the second side extends from the second cavity and past the second end of the end cap.

20. A furniture leg glide according to claim 19 wherein the piece of felt type material is bonded within the second cavity using an adhesive.

21. A furniture leg glide according to claim 13 wherein the piece of felt type material comprises a fibrous material that is for reducing damage to floors when slid across them.

22. A furniture leg glide according to claim 13 wherein the flexible coupling portion comprises a wall thickness, wherein the wall thickness of the flexible coupling portion is less than at least one of the upper and lower body portions thus permitting angular displacement of the upper body portion with respect to the lower body portion in such a manner that the flexible coupling portion extends on a first side and compresses on an opposite side during the angular displacement of the upper body portion with respect to the lower body portion.

23. A furniture leg glide according to claim 13 wherein the furniture leg glide comprises other than a spherical shape and other than felt type material disposed about the hollow body.

24. A method of installing a furniture leg glide onto a furniture leg comprising:

providing of a furniture leg glide comprising unitary construction and comprising a hollow body comprising a first end and a second end and a flexible coupling portion formed between the first end and the second end of the hollow body and a first cavity formed within the hollow body between the first and second ends thereof at an end cap where an aperture is formed at the first end of the hollow body for facilitating access to the first cavity;

grasping an outside surface of the hollow body;

sliding at least one of a furniture leg and a furniture leg glide into the first cavity;

terminating sliding of the furniture leg glide onto the furniture leg upon the furniture leg end contacting the second end of the hollow body; and, flexing at least a portion of the flexible coupling portion upon having an end of at least one of the furniture leg and the furniture leg glide contact the end cap attached to the hollow body.

25. A furniture leg glide comprising:

a hollow body comprising a first end and a second end;

an end cap formed at the second end of the hollow body;

a first cavity formed between the first end and the second end of the hollow body;

a first lip disposed on the body portion proximate the first end and extending inwardly and upwardly from the body portion for partially covering the first cavity;

a second lip disposed on the body portion proximate the first end approximately opposite the first lip and extending inwardly and upwardly from the body portion for partially covering the first cavity; and, an aperture formed between the first and second lips for facilitating access to the first cavity.

26. A furniture leg glide according to claim 25 wherein the second lip extends less than the first lip and wherein access to the first cavity is obstructed more by the first lip than the second lip.

27. A furniture leg glide according to claim 26 wherein the end cap comprises a first end coupled with the second end of the hollow body and a second end; and, a second cavity formed within the end cap proximate the second end of the end cap.

28. A furniture leg glide according to claim 27 comprising a piece of felt type material, wherein a portion of the piece of felt type material is disposed within the second cavity and another portion of the piece of felt type material extends from the second cavity for contacting a floor.

29. A method comprising:

providing a furniture leg glide comprising a hollow body having a first end and a second end;

providing an end cap formed at the second end of the hollow body;

providing a first cavity formed between the first end and the second end of the hollow body, where the first cavity is bounded on one side by the end cap;

providing a first lip disposed on the body portion proximate the first end and extending inwardly and upwardly from the hollow body for partially covering the first cavity; and, providing a second lip disposed on the hollow body proximate the first end and approximately opposite the first lip and extending inwardly and upwardly from the hollow body for partially covering the first cavity.

30. A method according to claim 29 comprising:

providing an aperture between the first and second lips for facilitating access to the first cavity;

providing a furniture leg having disposed thereon a swivel furniture leg glide having a swivel base; and, sliding a first end of the swivel base through the aperture and into the first cavity.

31. A method according to claim 30 comprising:

increasing a separation between the first and second lips;

sliding a second end of the swivel base, approximately opposite the first end of the swivel base, into the first cavity;

decreasing the separation between the first lip and the second lip; and, frictionally engaging the swivel base of the furniture leg glide between the end cap and the first and second lips.

32. A method according to claim 29 comprising:

providing a second cavity formed within the end cap opposite the swivel base of the furniture leg; and, disposing a piece of felt type material within the second cavity.

33. A method according to claim 29 wherein at least one of the first and second lips is manufactured from a flexible material.

* * * * *